United States Patent [19]

Rodi et al.

[11] Patent Number: 4,738,442

[45] Date of Patent: Apr. 19, 1988

[54] DEVICE FOR MONITORING SHEET TRANSPORT IN A FEEDER OF A PRINTING MACHINE

[75] Inventors: Anton Rodi, Leimen; Dieter Uhrig, Eberbach; Karlheinz Krestyn, Leimen, all of Fed. Rep. of Germany

[73] Assignee: Heidelberger Druckmaschinen AG, Heidelberg, Fed. Rep. of Germany

[21] Appl. No.: 791,358

[22] Filed: Oct. 25, 1985

Related U.S. Application Data

[63] Continuation-in-part of Ser. No. 724,791, Apr. 19, 1985, abandoned, which is a continuation of Ser. No. 499,213, May 31, 1983, abandoned.

[30] Foreign Application Priority Data

May 29, 1982 [DE] Fed. Rep. of Germany ..... 3220413

[51] Int. Cl.[4] ..... B65H 7/14

[52] U.S. Cl. ..... 271/261; 271/227; 271/265; 250/561

[58] Field of Search ..... 271/227, 228, 259, 261, 271/265, 258, 260; 250/560, 561; 340/674, 600

[56] References Cited

U.S. PATENT DOCUMENTS 4,434,759 6/1982 Clausing ..... 271/228 X

FOREIGN PATENT DOCUMENTS 53728 6/1982 European Pat. Off. ..... 271/258

*Primary Examiner*—Richard A. Schacher

*Attorney, Agent, or Firm*—Herbert L. Lerner; Laurence A. Greenberg

[57] ABSTRACT

A device for monitoring sheet transport at sheet feeders for printing machines includes at least one photo-sensor disposed above at each side, respectively, of the sheet feeder, apparatus for providing adjustable positioning of said photo-sensors in spaced relation to the leading edge and corners of the sheet; control logic responsively connected to the photo sensors for processing signals from the photo-sensor for producing a fault indication in case a sheet feeding failure is detected by the photo-sensors.

7 Claims, 6 Drawing Sheets

FIG. 4
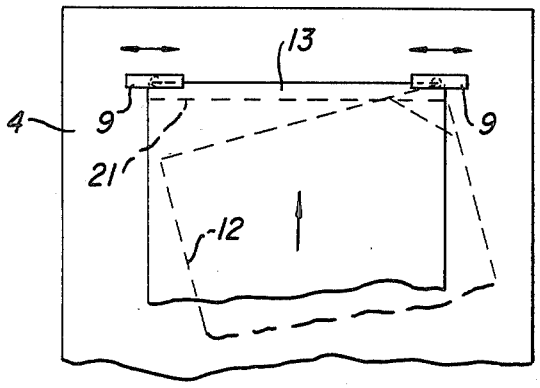
FIG. 5
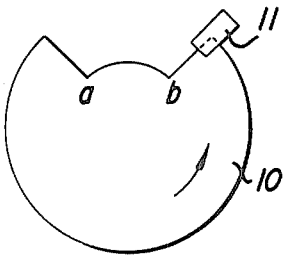
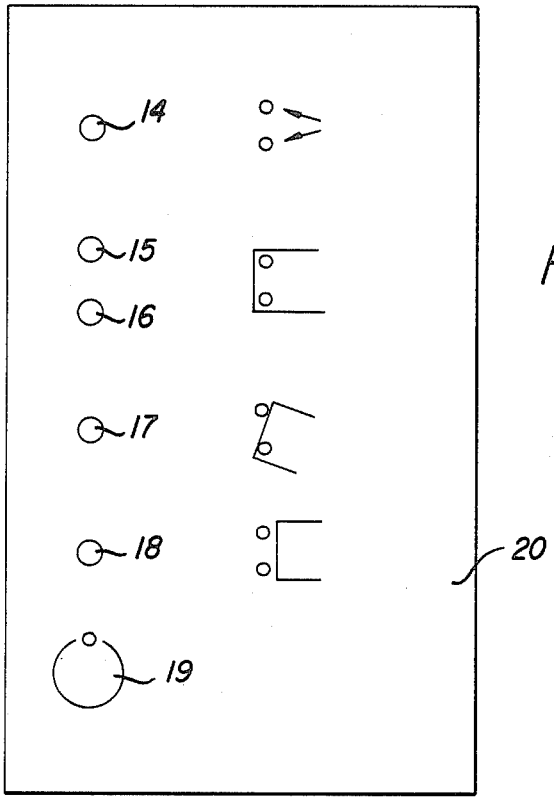
FIG. 6

DEVICE FOR MONITORING SHEET TRANSPORT IN A FEEDER OF A PRINTING MACHINE

This is a Continuation-In-Part of Pat. Application Ser. No. 724,791, filed Apr. 19, 1985, now abandoned, which was a Continuation of Application Ser. No. 499,213, filed May 31, 1983 now abandoned.

The invention relates to a device for monitoring sheet transport in a feeder of a printing machine and, more particularly, to such a device having a photoelectric measuring device located on a feeder table.

BACKGROUND OF THE INVENTION AND PRIOR ART

In printing machines, the sheets to be printed are fed by a sheet feeder, due to which the sheets are removed from a stack, over a feeder table furnished with conveyor belts to a sheet set-up or layout location of the printing machine. Trouble-free printing is achieved only when the sheets come to lie on the feeder table before take-over by the grippers exactly at the forward works and at the stop of lateral pulling marks. This sheet set-up is monitored by control devices which are formed of radiation sources and receivers responsive to the radiation (German Democratic Republic Patent No. 97,627). The sheets to be printed are passed under a lamp, and reflect the light emitted by this lamp to a light-sensitive receiver. In this case, the sheet set-up has answered or reported well, and the printing machine continues to operate without interruption. If a sheet, however, does not lie exactly at the forward marks or lateral pulling marks, the light beam is not reflected, the receiver reports "not good" and the sheet travel is interrupted. Likewise, overshooting of the sheets beyond the forward marks is controlled by these control devices.

Furthermore, the sensitivity adjustment of such photoelectric measuring devices with evaluation circuits responsive thereto depends sharply upon the amount of light absorption of the material to be processed. With thin printing materials in which the amount of absorption is very low, the increase of the sensitivity of the photoelectric measurement devices with such responsive evaluation circuits leads to an amplified glare sensitivity which then causes faulty measurements.

What is disadvantageous with these photoelectric measuring devices is that, respectively, a radiation source and a receiver are required, with either the radiation source or the receiver being located in the plane of the feeder table. Furthermore, the non-adjustable sensitivity adjustment of these photoelectric measuring devices have a disadvantageous effect upon the continuity of the printing process.

Briefly restated, the invention provides a system for monitoring the transport of sheets over a feeder table of a rotary sheet-printing machine, which includes the use of photoelectric sensing devices.

In such sheet printing machines, the sheets to be printed are fed by a sheet feeder which takes a sheet at the time from a stack of sheets and moves the sheets to the feeder table, which is equipped with conveyor belts. A perfect print can only be produced when the leading edge of the sheet is positioned on the table exactly aligned with leading edge markers on the table and the sides of the sheets are in alignment with side markers before the gripper grips the sheet, as described hereinabove. The position of the sheet on the table before it is to be gripped is monitored by the sensing devices which include radiation sources combined with corresponding radiation receivers shown generally as the photoelectric sensors 9.

Further still, in photoelectric sensing systems of the prior art which contain associated evaluation circuits, the sensitivity adjustment of the photoelectric sensors are highly dependent upon the light-absorbtion characteristics of the material to be printed. In the case of thin printing materials having very low light absorbtion characteristics, the sensitivity of the photoelectric sensors must be increased and, therefore, they become sensitive to interference from ambient light, which may lead to errors in the sensing process.

Therefore, in the conventional systems using photoelectric sensors based on a light radiation source and a receiver, it is a disadvantage when either one of the latter is disposed in the surface of the feeder table. Also, for the same reason conventional systems, which do not have adjustable photo-sensors, have a disadvantage in maintaining a continuous printing process.

The invention accordingly provides an uncomplicated solution for monitoring the feeding of sheets at any desired location of feeder table.

SUMMARY OF THE INVENTION

It is accordingly an object of the invention to provide a device for monitoring sheet transport in a feeder of a printing machine which solves in a very simple manner the heretofore required monitoring of the sheet transport at every desired location of the feeder table.

It is a more specific object of the invention to provide such a device by which irregularities, such as inclined sheets, faulty sheets and bent corners, for example, in the sheet supply in printing machines will be recognized in order, for example, to cause or induce an interruption in the sheet feed and to stop the sheet take-over when a warning message is received, in order to prevent damage to the blanket cylinder.

With the foregoing and other objects in view, there is provided, in accordance with the invention, a device for monitoring sheet transport in a feeder of a printing machine with a photoelectric measuring device located on a feeder table comprising at least one respective photoelectric sensor disposed on a side of the feeder facing towards a drive side and an operating side of the feeder, both the leading edges as well as the corners of the sheet being controllable by the respective sensors.

In accordance with another feature of the invention, the respective sensors have an arrangement over the width of the feeder table which is infinitely adjustable to different format widths of the sheet. A simple and rapid handling of the control device is assured by the required change-over of the printing machines which often occurs very rapidly.

In accordance with a further feature of the invention, the respective photoelectric sensors are adjustable to the degree of reflection of the surface of the feeder table.

The photoelectric sensors are likewise advantageously adjustable to the degree of reflection of the surface of the feeder table, whereby a recess formed in the feeder table or a change in the surface of the feeder table due, for example, to reflex foils (trip edge formation, friction) also in respect to a possible subsequent installation of the monitoring device, are unnecessary. Photo-electric sensors of this type are well known and are available, e.g. from the firm VISOLUX, LTD., 28

Clifton Industrial Estate, Cambridge, CB14BW, England.

In accordance with yet another feature of the invention, a control device is included with which the photoelectric sensors are coupled so that, through the intermediary of an interrogation switch, possible defects or soiled sensors are detected.

In accordance with added features of the invention, the control device has means for influencing control of the printing machine when disruptions occur, and a display field operatively connected to the control device for correspondingly displaying orderly transport of sheets and/or disruptions.

Briefly restated, the invention is based on a system for detecting any irregularities in the sheet feeding of printing machines, such as sheets that are slanted ("inclined"), defective or have bent corners and for stopping the feeding. Also, such irregularities are to stop the delivery of such sheets to the printing machine in order to avoid damage to the rubber surfaces of the machine. Further still, it is an object to detect possible sources for malfunctions such as defective or dirty sensors.

The solution to the problem, has been found, according to the inventive concept, to include at least one photo sensor on the drive side and on the operating side of the feeder. The photo sensors are mounted continuously adjustable on a transverse rod so that the leading edge as well as the corners of the sheet can be monitored by means of the photo sensors and the control logic connected therewith. With such an arrangement it is possible to attain an optimal sheet feeding arrangement.

Advantageously, the photo sensors are mounted continuously slidably on the traverse rod, so that they can be adjusted to any desired width. It is accordingly possible to reformat the printing machine in this simple, quick and readily adjustable manner.

In one embodiment of the invention, it is possible to adjust the photo sensors to the degree of reflectivity of the material to be printed as well as the reflectivity of the surface of the feeder table. In that way, recesses built into the surface of the feeder table can be avoided. It is also possible to avoid modification of the surface of the feeder table by such means as reflecting foils (trip edge build-up of paper dust) and the like.

A preferred embodiment of the invention provides that the photo sensors with assistance from the associated control logic and an interrogation switch based on the "early sheet" test cycle, is capable of detecting dirty photo sensors and, in case of irregularities, can affect the machine control and provide an indication thereof on a display field.

Other features which are considered as characteristic for the invention are set forth in the appended claims.

Although the invention is illustrated and described herein as embodied in a device for monitoring sheet transport in the feeder of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

BRIEF DESCRIPTION OF THE DRAWINGS

FIG. 3 is an interrogation disc in position a;

FIG. 4 is a plan view of the sheet at time $t_b$;

FIG. 5 shows the interrogator disc in position b;

FIG. 6 is a view of the display panel;

FIG. ll is a truth-table for the optical display elements.

DESCRIPTION OF THE PREFERRED EMBODIMENTS

Figure 1:
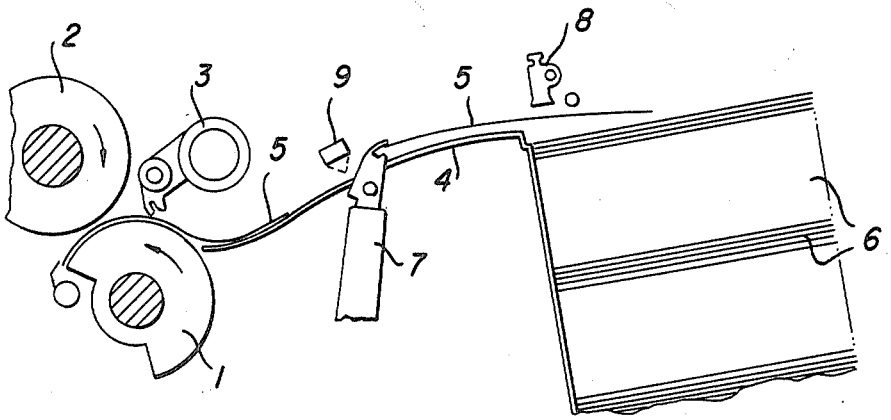
FIG. 1 is a single-sheet feeder with photo-sensors connected to a printing machine.

Referring now to the drawing and first, particularly to FIG. 1 thereof, there is shown an individual or single sheet feeder together with an impression cylinder 1, a gripper 3 and a blanket cylinder 2. Furthermore, a feeder table 4 with supply grippers 7 and a sheet 5 gripped by the supply gripper 7. Two photo-electric sensors 9 are fastened to an otherwise non-illustrated cross-beam or traverse above the feeder table 4. A suction tube 8 located above the sheet stack 6 belongs, in addition, to the illustrated individual sheet feeder.

Figure 2:
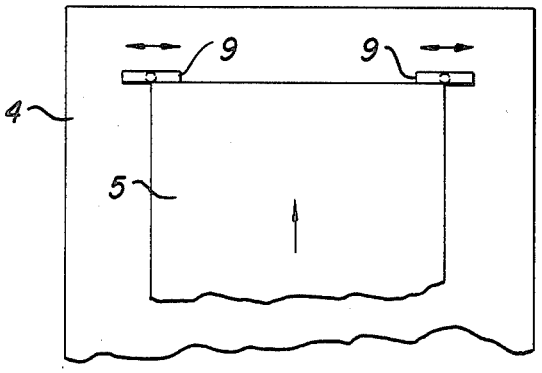
FIG. 2 is a plan view of the feeder table showing the position of a sheet at the time $t_a$.

In FIG. 2 there is shown a sheet 5 which lies on the feeder table 4 so that it is not yet located within response range of the photo-electric sensors 9. The photoelectric sensors 9 are so disposed that they are in a position, during inward travel of the sheet, to scan an outer lateral edge, respectively, of the sheet 5.

Figure 3:
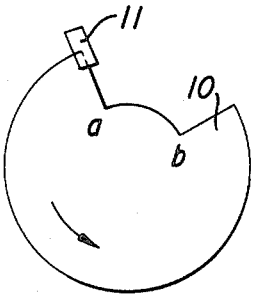

At this instant, illustrated in FIG. 2, an interrogation disc 10 which is coupled mechanically to the otherwise non-illustrated printing machine, is located in a position "a" with respect to an interrogation switch 11, as represented in FIG. 3.

In FIG. 4, the feeder table 4 is likewise shown with the photo-electric sensors 9 and three possible extreme positions 12, 13 and 21 of the sheet 5 during inward travel of the sheet. The properly supplied sheet 13 is located already within the response range, and the interrogation disc 10 in a position "b" with respect to the interrogation switch 11, as shown in FIG. 5.

In FIG. 6, a display field 20 with individual optical display elements 14 to 19 and lighting symbols assigned thereto are represented, which is attached to the operating side of the printing machine so as to be readily visible to the operator or printer.

In accordance with FIG. 1, during operation of the printing machine, the suction tube 8 grips the uppermost sheet 5 at the leading edge thereof, separates it from the stack 6 and transfers it to the supply grippers 7. The supply grippers 7 transport the sheet 5 over the feeder table 4 in direction towards the gripper 3. Only when the trailing edge of the sheet 5 has left the stack 6, can the next sheet be sucked up by the suction tube 8. The sheets 5 guided by the supply grippers 7 are transferred by the grippers 3 to the impression cylinder 1.

Before the sheet 5 has been taken over by the grippers 3, however, the correct position thereof should be controlled with the aid of the photo-electric sensors 9 and a control device. The sheet 5, as shown in FIG. 2, is not located yet within the response range of the photoelectric sensors 9 when the interrogation disc 10 which is synchronized with the rotational motion of the printing machine assumes the position a.

A this instant, at time $t_a$, an inspection or check is made whether or not a sheet 5 is located within the response range of the photo-electric sensors 9. If a sheet 5 is detected at least by one of the photo-electric sensors 9, then the optical display element 14 lights up as an alarm message "Early Sheet", and a transfer of the sheet 5 to the gripper 3 is prevented. The same alarm message and the prevention of sheet transfer occurs when there is a faulty adjustment of the photoelectric sensors 9 or soiling thereof.

While the sheet 5 in the supply grippers 7 has been guided further on the feeder table 4, the interrogation disc 10 synchronized with the rotational motion of the printing machine reaches the position b as shown in FIG. 5.

At the position b at time $t_b$, a check or inspection is made whether or not a sheet is located within the response range of the photo-electric sensors 9. If there is recognized that no sheet 5 is located within the response range of one of the photoelectric sensors 9, the optical display element 17 then lights up as a warning message "Inclined Sheet" and no sheet transfer occurs. If it is recognized at the instant $t_b$ that no sheet is located within the response range of both photoelectric sensors, the optical display element 18 lights up as a warning message "Faulty Sheet" and a sheet transfer is prevented.

If no sheet is located, however, within the response range of one photoelectric sensor 9 at the instant $t_a$, and a sheet is located within the response range of both photo-electric sensors 9 at the instant $t_b$, the optical display elements 15 and 16 light up as a message "Good Sheet", and a sheet transfer is enabled.

In the hereinbefore-described warning message "Early Sheet" 14 and "Inclined Sheet" 17, the fault can be assigned, with the aid of the optical display elements 15 and 16, to the respective edge of the sheet at which the fault has occurred. The non-lit display element, respectively, points towards the corresponding faulty side.

The optical display element 19 of the display field 20, reports the respective signal condition of the interrogation switch 31. This display 19 serves for controlling the function of the interrogation switch 11 and for synchronizing adjustment of the interrogation instant $t_a$ and $t_b$, respectively, at which a signal condition exchange, respectively, occurs.

The adjustment of the photo-electric sensors 9 is effected by bringing the photo-electric sensors 9 into a given position above the feeder table 4 on a cross-beam or traverse rod 49 disposed parallel to the leading edge of the paper sheet; in the given position of the sensors 9, the scanning point of the photo-electric sensors 9 being approximately 1 cm within the sheet format. The scanning sensitivity of the photo-electric sensors 9 is adjusted to the degree of reflection of the surface of the feeder table 4 by varying the response threshold value so that the feeder table 4 is reliably recognized as a reflex surface. Every sheet guided into the response range of the photo-electric sensor 9 varies the degree of reflection in a manner that falling short of the response threshold value results in the generation of a corresponding logic signal.

Restated in more detail, the single-sheet feeder shown in FIG. 1 shows an impression cylinder 1, a blanket cylinder 2 and gripper 3. Further, a feeder table 4 with supply grippers 7, which is gripping a sheet 5. Above the feeder table 4, there are shown two photo-sensors 9 mounted on a traverse rod 49 seen in FIG. 8. A suction tube 8 serves to lift a sheet 5 from the stack 6.

In accordance with FIG. 1, in the operation of the printing machine, the suction tube 8 draws the upper sheet 5, near its leading edge, from the stack 6 and transfers it to the supply grippers 7, The supply grippers 7 move the sheet 5 over the feeder table 4 in direction toward the gripper 3. Only when the rear edge if the sheet 5 has left the stack 6, can the next sheet be drawn up by the suction tube 8. The sheet 5 is delivered by the supply grippers 7 to the gripper 3 and to the impression cylinder 1.

Figure 7:
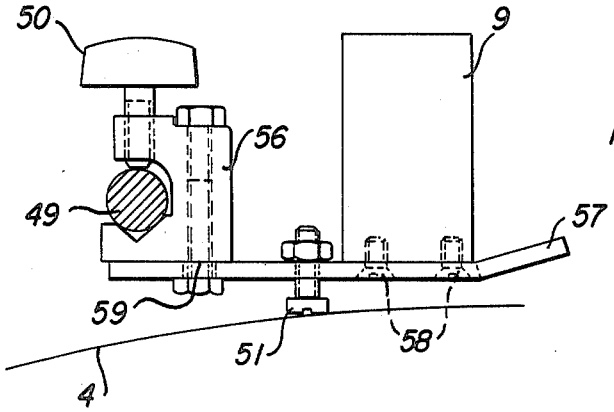
FIG. 7 is a side elevational view of the mounting of the photo-sensors.

FIG. 7 shows an elevational side view of the mounting of the photo-sensors 9. The photo-sensor 9 is mounted on a connection bar 57 by means of screws 58 or other suitable connection means.

The connection bar 57 is connected by a nut-and-bolt arrangement 59 to a clamping device 56, which serves to attach the clamping device 56 to a traverse rod 49 by means of a clamping screw 50.

The optional distance between the photo-sensor 9 and the feeder table 4 is set by means of an adjusting screw 51.

The transverse adjustment of the photo-sensors 9 for matching the width of the sheet 5 is done by loosening the clamping screw 50, whereby, the photo-sensors 9 can be slidably adjusted along the transverse rod 49, which is disposed transversely to the feeder table 4.

Figure 8:
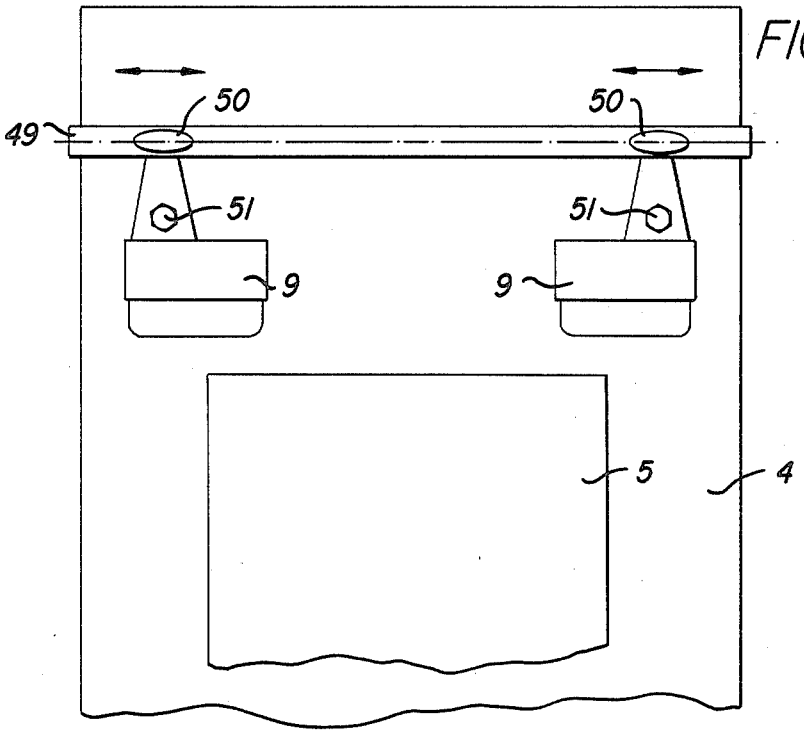
FIG. 8 shows an arrangement of the photo-sensors above the feeder table.

FIG. 8 shows, in plan view, the feeder table 4 with the transverse rod 49 mounted transversely above the feeder table 4.

As described hereinabove, the loosening of the clamping screws 50 makes it possible to adjust the photo-sensors 9 along the transverse rod 49 to match the corresponding format width of the sheet 5. The photo sensor 9 has an active response zone with a center which advantageously is adjusted to be within approximately one centimeter inside the perimeter of the sheet 5. The sensitivity of the photo-sensors 9 can be adjusted by adjusting the sensitivity threshold of the photo-sensor to the degree of reflectivity of the surface of the feeder table 4, such that the surface of the feeder table is distinctly detected.

Accordingly, whenever a sheet 5 is placed on the feeder table 4 within the response zone of the photo sensor 9, the reflection is changed by the presence of the sheet, so that the reflected light intensity falls below the photo-sensor's response threshold, thereby causing a corresponding logic signal to be generated by the associated logic circuit 52, described in more detail hereinbelow.

Before the sheet 5 is gripped by the grippers 3, the photosensors 9 monitor the position of the sheet to assure that the sheet is in its proper position on the feeder table 4.

As seen in FIG. 2, the sheet 5 is placed on the feeder table 4 such that it is not yet inside the response zone of the photosensors 9. The photo-sensors 9 are adjusted so that they monitor the corresponding side edges of the sheet 5.

As seen in FIG. 2, the sheet 5 is placed on the feeder table 4 such that it is not yet inside the response zone of the photo sensors 9. The photo sensors 9 are adjusted so that they monitor the corresponding side edges of the sheet 5.

At the time of the sheet position shown in FIG. 2, an interrogation disc 10 seen in FIG. 3, which is mechanically coupled to the printing machine, so that it rotates in synchronism therewith, is in the position shown in FIG. 3 with an edge a of a cutout in the disc just engaging an interrogation switch 11 which takes place at a time $t_a$.

FIG. 4 shows, in a plan view, three possible positions 12, 21 and 13 of a sheet 5, on the feeder table 4, in relation to the photo-sensors 9.

While the sheet 5 is moved along on the feeder table 4 by the supply grippers 7, the interrogation disc 10 is simultaneously rotating in synchronism with the printing machine until the edge b come into engagement with the interrogator switch 11, which takes place at the time $t_b$.

At the time $t_b$ a test is made to determine if the sheet 5 is within the response zone of the photo-sensors 9. As seen in FIG. 4, there are three possible positions of the sheet 5, indicated by reference numerals 12, 13 and 21. The position 13 is the proper position of the sheet where it should be at the time $t_b$, within the response zone of the photo-sensors 9. Position 12, designated as an "Inclined Sheet", in which only a corner of the sheet 5 is within the response zone of one of the photo-sensors 9 at the time $t_b$. In the position 21, which is designated a "Fault Sheet", none of the corners, nor the leading edge of the sheet are within the response zone of the photo-sensors 9, at time $t_b$.

Between the interrogation times $t_a$ and $t_b$, the control logic 52 connected to the photo-sensors 9 performs a test to determine that, at time $t_a$, there is no signal from either photo-sensor 9, and that, at time $t_b$, there is a signal from both photo-sensors 9. If a sheet is in such a position that both of these conditions are not satisfied, then it is known that a fault in the feeding has occurred.

Figure 9:
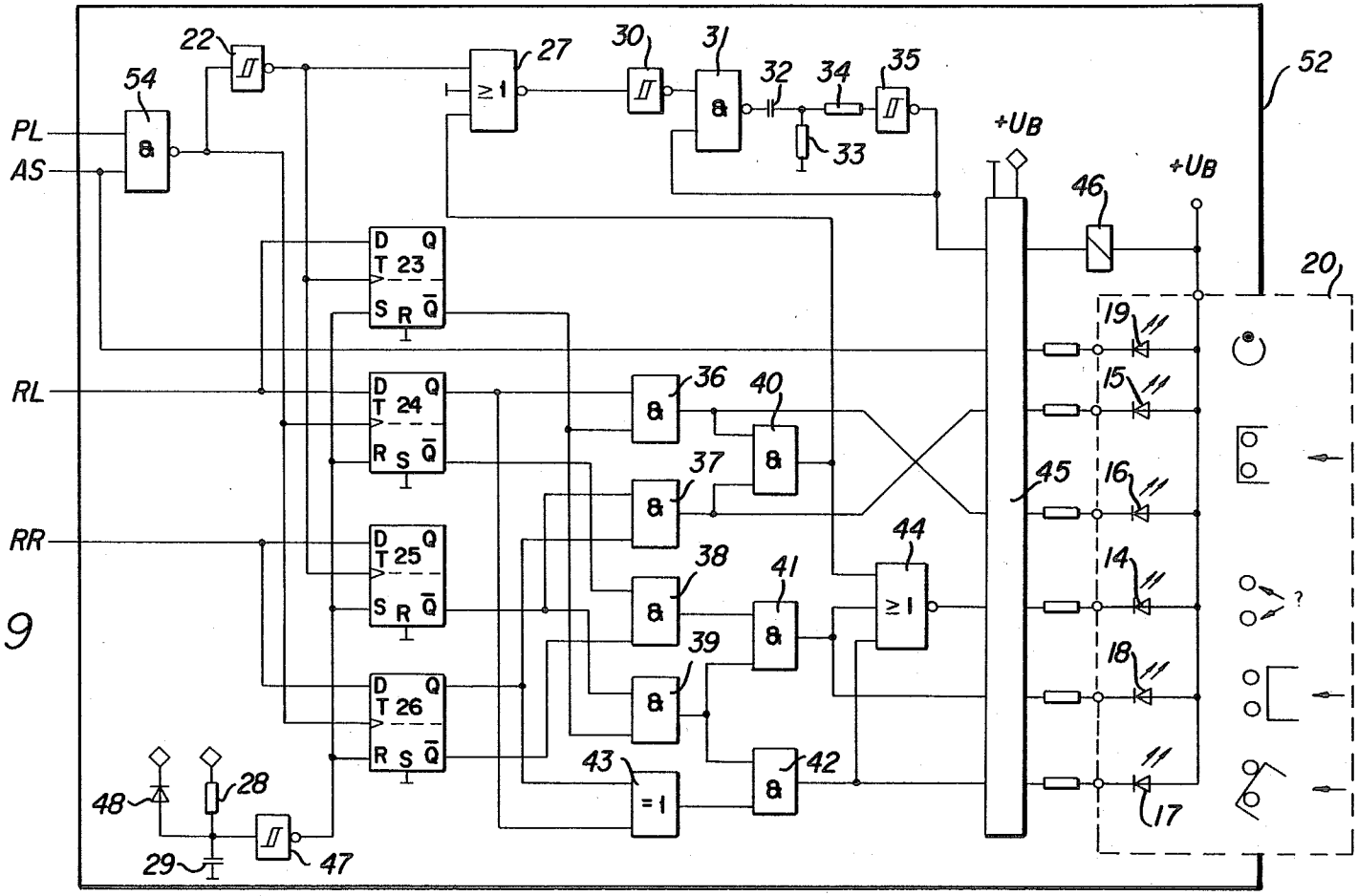
FIG. 9 is a schematic circuit diagram of an embodiment of the control logic.

FIG. 9 is a schematic circuit diagram of the control logic with an associated display field 20 which shows the optical indicators 14–19 and the light symbols associated therewith. The display field 20 is positioned so that it is clearly visible to the printing machine operator from his control station at the machine.

The control logic 52 operates as follows: The signal AS from the interrogation switch 11 (FIGS. 3 and 5) is connected via a transistor array 45 to the optical indicator 19. At the same time, the signal AS is connected to the lower input of a NAND-gate 54, while a "paper running" signal PL is connected to the upper input of NAND-gate 54. The signal PL is a steady signal that is combined with the pulsing signal AS from the interrogator switch 11. Assuming that the edge a of the interrogator disc 10 is in engagement with the interrogator switch 11, then the signal AS, which goes high, is connected via the NAND-gate 54 and the inverter 22 to the clock inputs T of the flip-flops 23 and 25. At this time ($t_a$) there should be no paper present under either one of the photo sensors 9. The two photo-sensors 9, namely the right hand and the left hand sensor, respectively, produce two signals RR and RL, respectively, seen entering the circuit of FIG. 9. The signal RL is connected to the data input D of the flip-flops 23 and 24, while the signal RR is connected to the data input D of the flip-flops 25 and 26.

If the clock at inputs T of flip-flops 23 and 25 goes from high to low, while the signals RL or RR are high, then the condition at the D-input is transmitted to the flip-flop outputs Q and Q, as is conventional in a clocked flip-flop operation. The outputs Q of the flip-flops 23 and 25 are logically combined in the AND-gates 36, 37 and 39, which go high.

Next, at the time $t_b$, the signal AS from the interrogation switch 11 goes low again, as the edge b of the interrogator disc 10 engages the switch 11, and appears now at via NAND-gate 54 the clock inputs T of the flip-flops 24, 25 as a low-going signal. If, at this time ($t_b$) there is paper under the photo-sensors 9, then the corresponding high state of the RL and RR signals are transferred from the data input D of flip-flops 24, 25 to the outputs Q, Q, as high and low, respectively. The outputs Q of the D-flip-flops 24 and 26 are connected to the AND-gates 36 and 37, as well as to the exclusive OR-gate 43 and go high. The corresponding outputs Q are combined at the AND-gate 38 and go low. The output signals from these gates are further combined at the AND-gates 40, 41 and 42 and a NOR-gate 44, which are turned on, and in this case activate the optical indicators 15 and 16.

Figure 11:
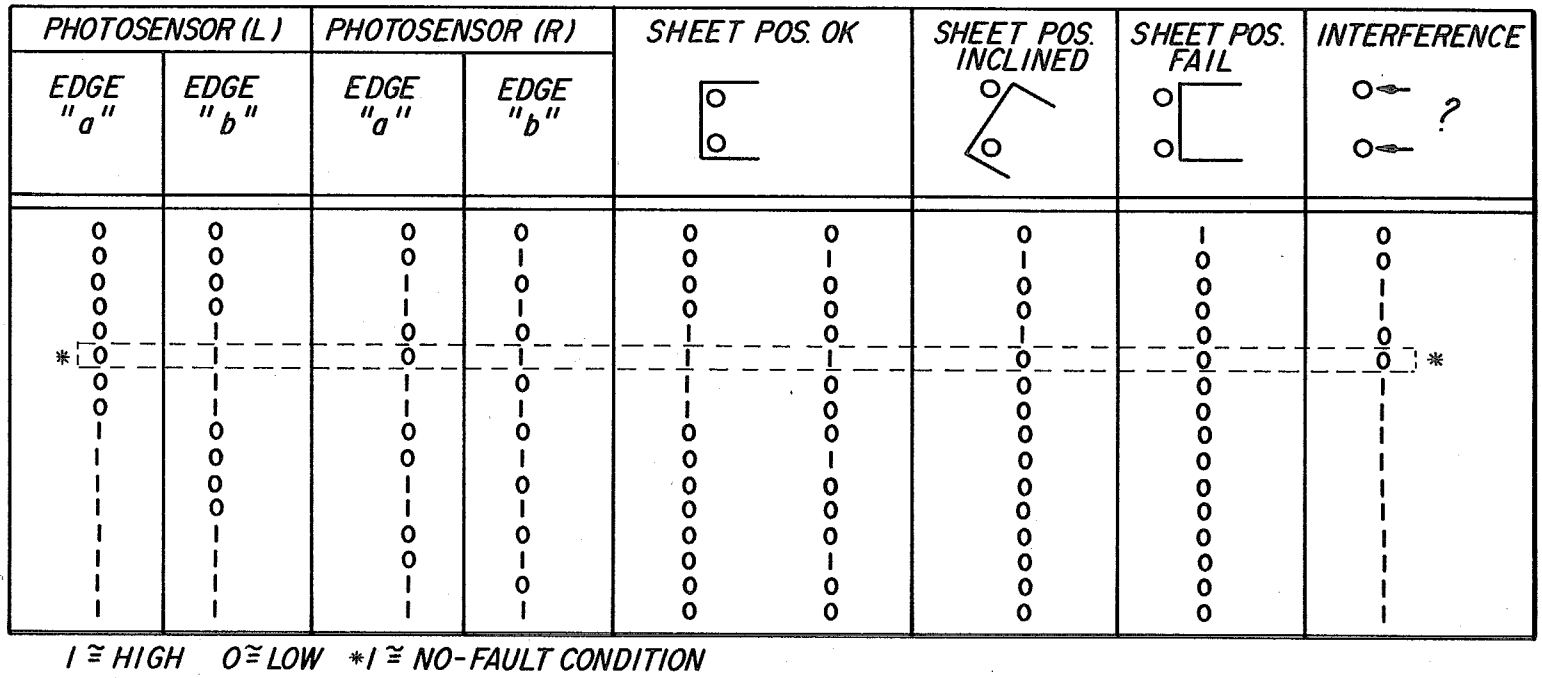

The plurality of possible combinations created by the states of the input signals RL, RR in connection with the edges a and b of the interrogator disc 10, and their representation by the indicators 14–19 are shown in the truth tables seen in FIG. 11.

In the case of an error message or fault (such as inclined sheet 12 or faulty sheet 21), the indicators 14 or 18 or 17 are turned on, and at the same time, the fault relay 46 is operated. The recognition of the failure takes place when the edge b engages the interrogation switch 11 (time $t_b$). The output of the AND-gate 40 goes low after the fault has been recognized, and is, at the NOR-gate 27, combined with the signal AS from inverter 22. The output of the NOR-gate 27 is inverted in the inverter 30 and then connected to a "one-shot" consisting of the AND-gate 31, capacitor 32, resistors 33, 34 and the inverter 35.

The output of the inverter 35 is normally high and is combined, via the NAND-gate 31, with the output of the inverter 30. Depending upon the time constant of the RC-combination 32–34, the output from the inverter 35 briefly goes low. The transistor array 45 becomes enabled and momentarily drops the fault relay 46. A contact 53 of the relay 46, seen in FIG. 10, is connected with the machine control 55, such that the sheet 5 is not inserted into the printing machine.

When power is connected to the control logic 52 (FIG. 9), a conventional power-up circuit consisting of components 28, 29, 47 and 48 (resistor 28, capacitor 29), inverter 47 and rectifier diode 48, respectively serves to initialize the flip-flops 23–26 to the states set, reset, set and reset, respectively.

Figure 10:
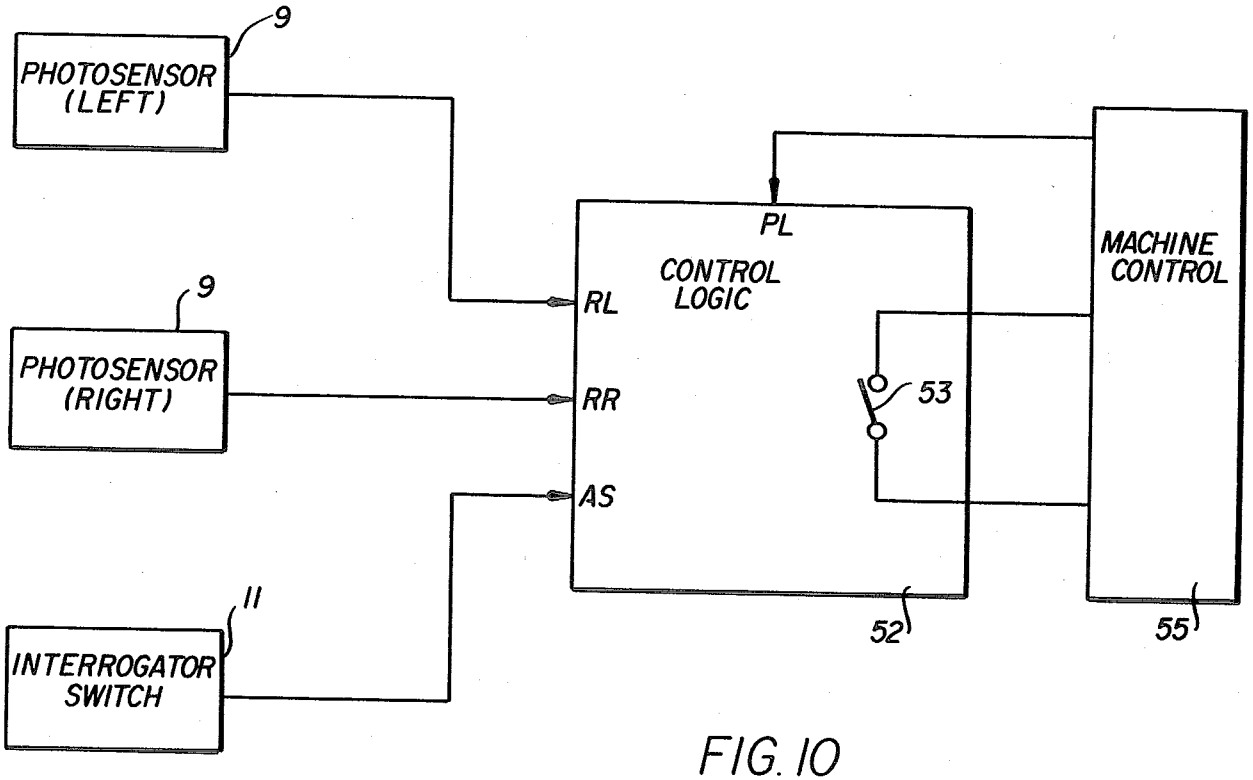
FIG. 10 is a block diagram of the relevant elements of the invention.

FIG. 10 shows a block diagram of all the relevant parts of the control system.

The signals RL and RR from the photo-sensors 9, left and right, respectively, disposed at the operating side and the driving side, respectively, of the sheet feeder, and the signal AS from the interrogator switch 11 are connected to the control logic 52. The machine control 55 sends a command PL to activate the control logic 52. This command may, for example, be the "paper running" signal, coming from the machine control. The contact 53 operated by the failure relay 46, is directly connected to the machine control 55, which is conventional and not shown in detail, since the invention is not directed thereto, and causes, in case of sheet feeding failure, the machine to stop and/or to stop the feeding of the sheets into the machine.

The scope of the invention, which provides a leading edge method of monitoring sheet feed, is not limited to single-sheet feeding of printing machines but is applicable to any application of sheet feeders wherein at least a leading edge of the sheet can be monitored.

The device according to the invention, ensures a corner, leading-edge control not only for the hereinafore-described individual sheet feeders, but also within ranges for fish-scale or overlapping sheet feeders at which at least the leading edge of the sheet can be scanned individually.

We claim:

1. Device for monitoring sheet transport at sheet feeders for printing machines, comprising:

at least two photo-sensors disposed above at each side, respectively, of the sheet feeder; means for providing adjustable positioning of said photo-sensors in spaced relation to the leading edge and corners of the sheet; control logic responsively connected to the photo sensors for processing signals from the photo-sensors for producing a fault indication in case a sheet feeding failure is detected by the photo-sensors.

2. Device for monitoring sheet transport at sheet feeders according to claim 1, wherein said means for providing adjustable positioning of the photo-sensors further comprise a transverse rod transversely disposed between the sides of said sheet feeder, rigidly attached thereto, for mounting the photo-sensors.

3. Device for monitoring sheet transport according to claim 2 wherein said sides of the sheet feeder comprise a drive side and an operating side.

4. Device for monitoring sheet transport according to claim 3 wherein said photo-sensors are slidably mounted on said traverse rod for adjusting the position of the photo-sensors to any desired format width of the sheet.

5. Device for monitoring sheet transport according to claim 1, further comprising a feeder table for supporting the sheet, wherein said photo-sensors have adjustable sensitivity relative to the surface reflectivity of the feeder table.

6. Device for monitoring sheet transport according to claim 1, further comprising an interrogation switch operating in synchronously timed relationship with said sheet feeder, said interrogation switch operatively engaging the control logic at predetermined times for timingly detecting defective or dirty conditions of the photo-sensors.

7. Device for monitoring sheet transport according to claim 1, further comprising a display field operatively responsive to said control logic for displaying proper sheet transport and/or deviations therefrom.

* * * * *